US010618610B2

(12) United States Patent
de Jager

(10) Patent No.: US 10,618,610 B2
(45) Date of Patent: Apr. 14, 2020

(54) WATERSPORT BOARDS AND METHODS FOR FORMING THE SAME

(71) Applicant: Vista Outdoor Operations LLC, Anoka, MN (US)

(72) Inventor: Wim de Jager, Park City, UT (US)

(73) Assignee: VISTA OUTDOOR OPERATIONS LLC, Anoka, MN (US)

( * ) Notice: Subject to any disclaimer, the term of this patent is extended or adjusted under 35 U.S.C. 154(b) by 0 days.

(21) Appl. No.: 15/593,199

(22) Filed: May 11, 2017

(65) Prior Publication Data

US 2018/0327061 A1 Nov. 15, 2018

(51) Int. Cl.

| | |
|---|---|
| ***B63B 35/81*** | (2006.01) |
| ***A63C 5/03*** | (2006.01) |
| ***B63B 35/79*** | (2006.01) |

(52) U.S. Cl.

CPC ..... *B63B 35/7909* (2013.01)

(58) Field of Classification Search

CPC . B63B 35/79; B63B 35/7906; B63B 35/7909; B63B 35/7916; B63B 2035/79; B63B 2035/7903

USPC ..... 441/65, 74

See application file for complete search history.

(56) References Cited

U.S. PATENT DOCUMENTS

| | | | |
|---|---|---|---|
| 8,932,094 | B2 | 1/2015 | Filen |
| 9,216,801 | B2 | 12/2015 | Barron |
| 9,248,889 | B2 | 2/2016 | Brouwer et al. |
| 2009/0165697 | A1 | 7/2009 | Caldwell |
| 2011/0114007 | A1 | 5/2011 | Flemons, III |
| 2013/0280971 | A1 | 10/2013 | Dovell |
| 2014/0037888 | A1 | 2/2014 | O'Reilly et al. |
| 2014/0099500 | A1 | 4/2014 | Schnerb et al. |
| 2014/0216326 | A1 | 8/2014 | Driscoll |

FOREIGN PATENT DOCUMENTS

| | | |
|---|---|---|
| WO | WO 1983/002747 | 8/1983 |

*Primary Examiner* — Daniel V Venne

(74) *Attorney, Agent, or Firm* — Amardeep S. Grewal; Gerard M. Donovan; Reed Smith LLP

(57) ABSTRACT

Watersport boards and methods for forming the same. A watersport board includes an elongate shell and at least one infusion member within a shell internal volume of the elongate shell. The shell internal volume includes a shell void volume that contains a shell fill material and an infusion member volume. The infusion member weighs less than an equal volume of the shell fill material. The at least one infusion member may be or include an infusion sleeve, which defines an infusion sleeve volume that contains an infusion fill material that is less dense than the shell fill material. A method of forming a watersport board includes forming an elongate shell that defines a shell internal volume, positioning at least one infusion member within the shell internal volume, and filling the shell void volume with a shell fill material.

27 Claims, 4 Drawing Sheets

WATERSPORT BOARDS AND METHODS FOR FORMING THE SAME

FIELD

The present disclosure relates to watersport boards and methods for forming the same.

BACKGROUND

Watersport boards such as surfboards and stand-up paddleboards (SUPS) generally are configured to permit a user to stand upon an upper surface of the watersport board while the watersport board floats in a body of water. The material construction of a watersport board may be selected to optimize properties and characteristics of the watersport board, such as to produce a watersport board that is durable, lightweight, maneuverable, and/or stable. Traditional manufacturing techniques may introduce tradeoffs between such properties and characteristics. For example, increasing the durability of a watersport board may correspond to increasing the weight of the board, and decreasing the weight of the board may limit the durability and/or stability of the board. Thus, there exists a need for watersport boards that are lightweight and durable.

SUMMARY

Watersport boards and methods for forming the same are disclosed herein. A watersport board includes an elongate shell that defines a shell internal volume of the watersport board. The elongate shell includes a nose, a tail, a left rail, a right rail, and a deck, wherein each of the left rail and the right rail extends between the nose and the tail, and wherein the deck extends between the nose and the tail and between the left rail and the right rail. The deck is configured to support a user standing upon the deck when the watersport board operates (i.e., is used) upon a body of water.

The watersport board further includes at least one infusion member positioned within the shell internal volume. The at least one infusion member may be spaced apart from each of the left rail and the right rail within the shell internal volume. Each of the at least one infusion member may be a solid or hollow structure, and in some embodiments may be or include an infusion sleeve. The at least one infusion member defines an infusion member volume and is formed from an infusion member material. The shell internal volume defines a shell void volume between the inner surface of the elongate shell and the exterior of the at least one infusion member. When the at least one infusion member is at least one infusion sleeve, the at least one infusion sleeve defines an infusion sleeve internal volume, such that the shell internal volume is separated by the at least one infusion sleeve into the infusion sleeve internal volume and the shell void volume.

The watersport board further includes a shell fill material positioned within the shell void volume. The shell fill material surrounds the at least one infusion member and thus occupies all or at least substantially all of the shell void volume. When the at least one infusion member includes at least one infusion sleeve, the at least one infusion sleeve may be formed from the infusion member material and the at least one infusion sleeve may be filled with an infusion fill material. The infusion fill material may be solid or gaseous, or a combination thereof. The shell fill material has a greater density than one or more of the at least one infusion member, the infusion member material, and/or the infusion fill material. Additionally or alternatively, The infusion fill material and/or the infusion member material is/are less dense than the shell fill material. The infusion member material may be the same as or different than the infusion fill material.

A method of forming a watersport board includes forming an elongate shell that defines a shell internal volume of the watersport board and positioning at least one infusion member, which may be or include at least one infusion sleeve, within the shell internal volume. The method further includes filling the shell void volume with the shell fill material, which surrounds the at least one infusion member. When the at least one infusion member includes at least one infusion sleeve, the method may further include filling the at least one infusion sleeve with an infusion fill material that has a lower density than the shell fill material. The at least one infusion sleeve may be filled with the infusion fill material before or after the at least one infusion sleeve is inserted within the shell internal volume.

DETAILED DESCRIPTION

FIGS. 1-9 provide examples of watersport boards 100 according to the present disclosure and/or of methods 200 for forming watersport boards 100. Elements that serve a similar, or at least substantially similar, purpose are labeled with like numbers in each of FIGS. 1-9, and these elements may not be discussed in detail herein with reference to each of FIGS. 1-9. Similarly, all elements may not be labeled in each of FIGS. 1-9, but reference numbers associated therewith may be utilized herein for consistency. Elements, components, and/or features that are discussed herein with reference to one or more of FIGS. 1-9 may be included in and/or utilized with the subject matter of any of FIGS. 1-9 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
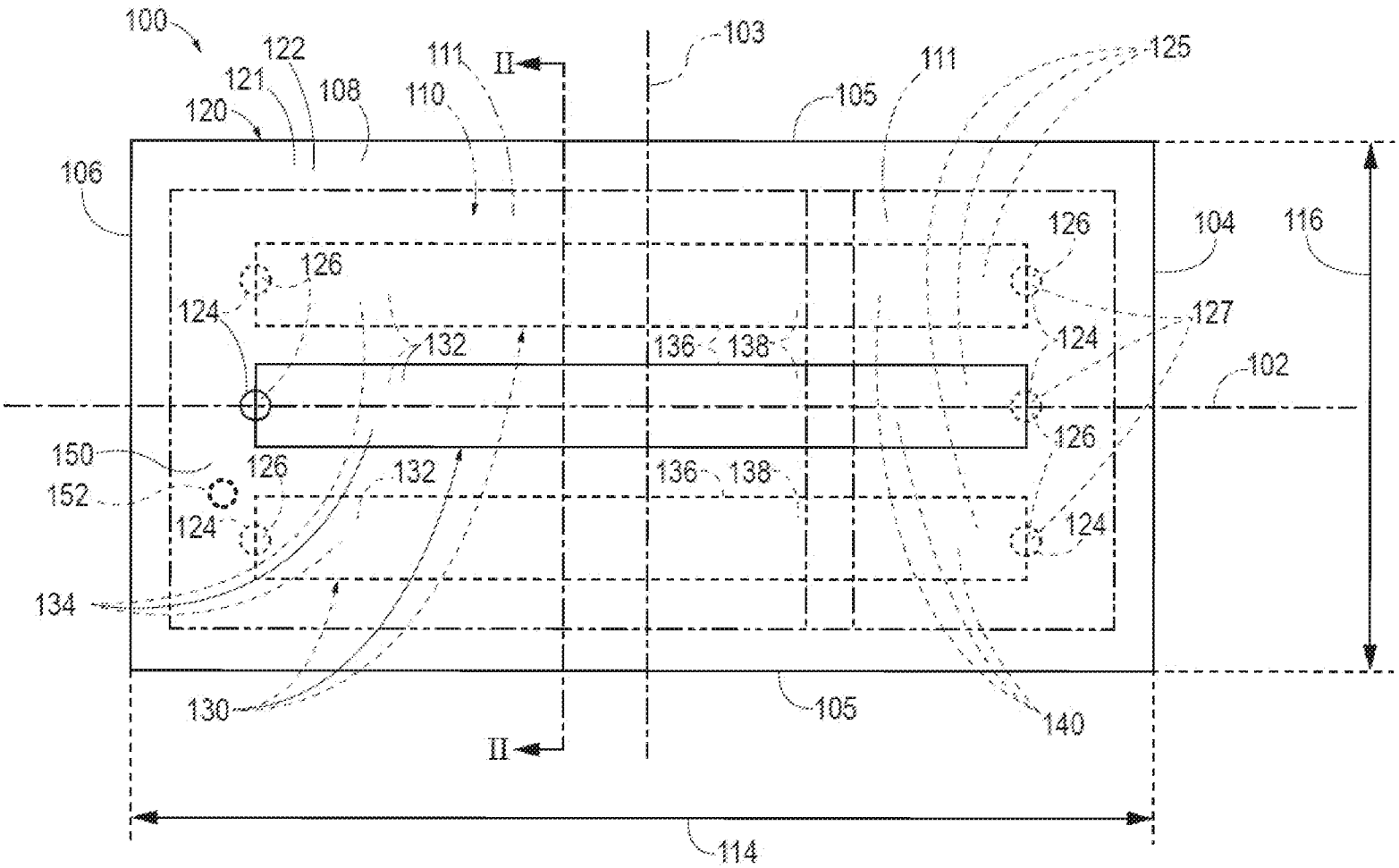
FIG. 1 is a schematic plan view representing examples of watersport boards according to the present disclosure.
Figure 2:
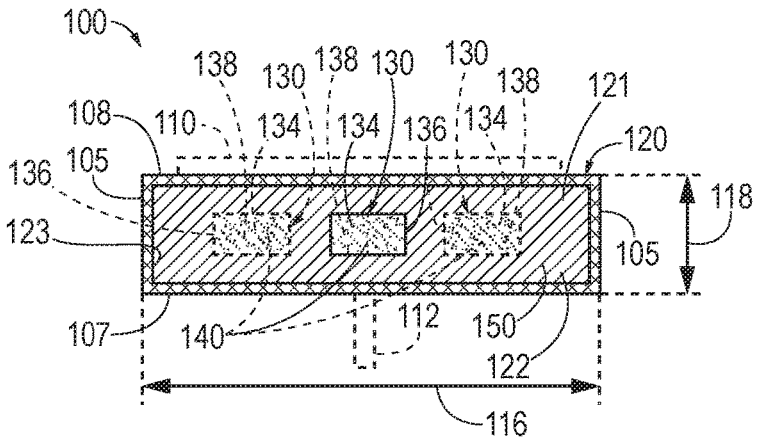
FIG. 2 is a schematic cross-sectional elevation view of the watersport boards of FIG. 1 taken along line II-II in FIG. 1.

As schematically illustrated in FIGS. 1-2, a watersport board 100 includes an elongate shell 120 that defines a shell internal volume 121 of the watersport board. Watersport board 100 further includes at least one infusion member 130 positioned within the shell internal volume. The at least one infusion member 130 is formed from at least one infusion member material 132 (schematically illustrated in FIG. 1) and defines an infusion member volume 134. The infusion member volume 134 thus is a subset of shell internal volume 121, such that the shell internal volume is separated into the infusion member volume 134 and a shell void volume 122 that is not occupied by an infusion member. Stated differently, the at least one infusion member 130 separates shell internal volume 121 into infusion member volume 134 and shell void volume 122.

Watersport board 100 further includes a shell fill material 150 positioned within shell void volume 122 and surrounding the at least one infusion member 130. The at least one infusion member 130 and/or infusion member material 132 may be less dense than the shell fill material 150, such that a total mass of the infusion member is less than the total mass of an equal volume of the shell fill material. As a result, the mass of watersport board 100 is less than that of an otherwise identical watersport board that includes additional shell fill material in place of the at least one infusion member 130. It is within the scope of the present disclosure that shell fill material 150 may be more durable than infusion member 130 and/or infusion member material 132, such that watersport board 100 is more durable than an analogous watersport board that contains the infusion member material positioned throughout shell internal volume 121.

Infusion member material 132 and shell fill material 150 may include and/or be any appropriate materials, such as may be known in the field of watersport boards, such that the infusion member weighs less than an equal volume of the shell fill material. As examples, infusion member material 132 may include and/or be a plastic, a polymer, a foam, and/or expanded polystyrene (EPS). As further examples, shell fill material 150 may include and/or be a plastic, a polymer, a foam, and/or polyurethane (PU). Infusion member material 132 and shell fill material 150 generally may include and/or be different materials.

Shell void volume 122 and the at least one infusion member 130 collectively may occupy any suitable proportion of shell internal volume 121. For example, shell void volume 122 and infusion member(s) 130 collectively may occupy an entirety of shell internal volume 121, a substantial entirety of the shell internal volume, and/or at least 95% of the shell internal volume. Similarly, shell fill material 150 may occupy any suitable proportion of shell void volume 122. As examples, shell fill material 150 may occupy at least 75%, at least 80%, at least 85%, at least 90%, at least 95%, at least 99%, and/or 100% of shell void volume 122. Thus, it is within the scope of the present disclosure that watersport board 100 may include additional components within shell internal volume 121, but any such additional components typically will occupy a minority of the shell internal volume, such as less than 10%, less than 5%, less than 3%, and/or less than 1% of the shell internal volume.

As discussed in more detail herein, each infusion member 130 may be a solid or a hollow structure. When the infusion member 130 is a solid structure, it may be entirely formed from a single infusion member material 132, although it is within the scope of the present disclosure that infusion member 130 may be formed from two or more infusion member materials. When the infusion member 130 is hollow, the infusion member may be described as being formed from at least one infusion member material 132 that forms the solid and/or exterior portion of the infusion member, and at least one infusion member material 132 that occupies the hollow interior portion, or cavity, of the infusion member. As illustrated in FIGS. 1-2, an example of such a hollow infusion member 130 includes an infusion sleeve 136, which defines an infusion sleeve internal volume 138, which is a subset of infusion member volume 134. Examples of suitable materials for infusion sleeve 136 include the above-discussed examples of infusion member material 132 as well as a foil, an air-impermeable material, and/or carbon fiber. The infusion member material 132 that fills or otherwise occupies the infusion sleeve internal volume 138 additionally or alternatively may be referred to as an infusion fill material 140. The infusion fill material 140 may be a solid, a gas, and/or combinations thereof.

Watersport board 100 may include and/or be any apparatus configured to support a user standing upon a surface thereof while the watersport board floats or otherwise operates upon a body of water. As examples, watersport board 100 may include and/or be a surfboard, a paddleboard, a stand-up paddleboard (SUP), and/or a windsurfing board. As schematically illustrated in FIGS. 1 and/or 2, elongate shell 120 may be described as having a nose 104, a tail 106 opposite the nose, and a pair of rails 105 extending along the left and right sides of the watersport board and between the nose and the tail. As used herein, the pair of rails 105 also may be referred to as and/or be described as including a left rail 105 and a right rail 105. Elongate shell 120 further may be described as including a bottom 107 configured to face and/or be submerged in the body of water when watersport board 100 operates on the body of water. Bottom 107 also may be described as at least partially defining an underside of watersport board 100. Elongate shell 120 may be formed of any appropriate waterproof material, an example of which is high-density polyethylene (HDPE).

As further illustrated in FIGS. 1-2, watersport board 100 may have a deck 108 configured to support the user when the watersport board operates on the body of water. Deck 108 may include and/or be a top surface of elongate shell 120, and/or may be operatively attached to an entirety, or at least a substantial entirety, of the top surface of the elongate shell. Watersport board 100 further may include a deck pad 110 positioned on at least a portion of deck 108. As schematically illustrated in FIG. 1, deck pad 110 may include two or more spaced-apart deck pad components, or sections, 111. Deck pad 110 may be configured to aid the user in standing upon the watersport board without slipping. For example, deck pad 110 may have a coefficient of static friction against the user's bare foot that is greater than a coefficient of static friction between deck 108 and the user's bare foot. Deck pad 110 may be operatively attached to and/or coupled to deck 108 in any appropriate manner, such as by gluing, cementing, adhering, laminating, screwing, and/or using a mechanical fastener.

As used herein, positional terms such as "front," "forward," "rear," "backward," "left," "right," "upper," "top," "lower," "underside," and the like are considered from the point of view of a user standing upon deck 108 and/or deck pad 110 and facing nose 104. Hence, nose 104 may be described as being forward of tail 106, and deck pad 110 may be described as being positioned on a top surface of watersport board 100 and/or deck 108.

As schematically illustrated in FIG. 2, watersport board 100 further may include at least one fin 112 extending from bottom 107 of elongate shell 120. Hence, fin 112 may extend from the underside of watersport board 100 into the body of water when the watersport board operates upon the body of water, such as to stabilize the watersport board in the body of water. Watersport board 100 may include any appropriate number of fins 112, such as one fin, two fins, three fins, or more than three fins.

As schematically illustrated in FIG. 1, elongate shell 120 may include and/or define at least one infusion member port 124, which may be utilized during manufacture of watersport board 100, as described herein. Infusion member port 124 may include and/or be an opening in elongate shell 120, such as may permit access to shell internal volume 121 from external the elongate shell. As an example, infusion member port 124 may be configured to permit infusion member 130 to enter shell internal volume 121 via the infusion member port during manufacture of watersport board 100. To isolate shell internal volume 121 from an exterior of elongate shell 120 in a watertight manner, infusion member port 124 may receive and/or be sealed by a corresponding shell plug 126. Shell plug 126 may extend at least partially, and optionally fully, through elongate shell 120. As examples, shell plug 126 may extend from elongate shell 120 at least partially into shell internal volume 121, and/or may extend from the elongate shell on an exterior side of watersport board 100. Additionally or alternatively, and as schematically illustrated in FIG. 1, shell plug 126 may include and/or be coupled to a corresponding accessory mount 127. Accessory mount 127 may be positioned in and/or on shell plug 126, deck 108, and/or deck pad 110. Accessory mount 127 may be configured to be operatively coupled to a component of watersport board 100 and/or to a separate accessory to be utilized with the watersport board. As examples, accessory mount 127 may include and/or be a handle, an anchor, and/or a tie-down point.

As further illustrated in FIG. 1, watersport board 100 further may include at least one infusion member retention structure 125 operatively coupled to at least one infusion member 130. Infusion member retention structure 125 may be configured to retain infusion member 130 in a fixed, or at least substantially fixed, orientation with respect to shell internal volume 121 and/or another infusion sleeve at least prior to insertion and curing and/or solidification of shell fill material 150 around the at least one infusion sleeve. Infusion member retention structure 125 may include and/or be any structure appropriate for coupling to and/or retaining infusion member 130 relative to the shell internal volume. As examples, infusion member retention structure 125 may include and/or be a loop, a plastic loop, a wire loop, a rope, a string, a collar, a rigid collar, and/or a bar. Infusion member retention structure 125 may couple infusion member 130 to any appropriate component of watersport board 100, such as to shell plug 126 that extends at least partially through elongate shell 120. Additionally or alternatively, infusion member retention structure 125 may be integrated with and/or form a portion of shell plug 126, and/or may be defined by elongate shell 120. Additionally or alternatively, infusion member retention structure 125 may extend between and operatively couple at least two infusion members 130 to one another.

With continued reference to FIG. 1, watersport board 100 may be described as having a shell longitudinal axis 102 that extends along an elongate dimension thereof such that the elongate shell is symmetric, or at least substantially symmetric, with respect to the shell longitudinal axis, and/or a shell transverse axis 103 that is perpendicular, or at least substantially perpendicular, to shell longitudinal axis 102. Shell transverse axis 103 may intersect shell longitudinal axis 102 at any appropriate point, such as at a midpoint thereof.

Additionally, as illustrated in FIGS. 1-2, watersport board 100 may be characterized by a board length 114 (indicated in FIG. 1), as measured in a direction parallel to shell longitudinal axis 102 and between nose 104 and tail 106, a board width 116, as measured between left rail 105 and right rail 105 and along shell transverse axis 103, and a board thickness 118 (indicated in FIG. 2), as measured in a direction perpendicular to each of the shell longitudinal axis and the shell transverse axis. Board length 114, board width 116, and board thickness 118 may be any appropriate dimensions, such as may be conventional in the watersport board industry. As examples, board length 114 may be at least 1 meter (m), at least 2 m, at least 3 m, at least 4 m, at most 5 m, at most 3.5 m, at most 2.5 m, and/or at most 1.5 m. As further examples, board width 116 may be at least 0.25 m, at least 0.5 m, at least 0.75 m, at least 1 m, at least 1.5 m, at most 2 m, at most 1.75 m, at most 1.25 m, at most 0.8 m, at most 0.6 m, and/or at most 0.3 m. As yet further examples, board thickness 118 may be at least 5 centimeters (cm), at least 10 cm, at least 20 cm, at least 30 cm, at least 40 cm, at most 45 cm, at most 35 cm, at most 25 cm, at most 15 cm, and/or at most 7 cm.

As discussed, watersport boards 100 according to the present disclosure may have a watersport board mass that is less than a mass of an analogous watersport board that lacks infusion member(s) 130 and thus has a shell volume that is filled with additional shell fill material 150 instead of the infusion member(s). Stated differently, infusion member(s) 130 may be configured to reduce an overall weight of watersport board 100. As discussed, each infusion member 130 is formed from one or more infusion member materials 132 such that the overall infusion member may be less dense than shell fill material 150, and thus less massive than an equal volume of the shell fill material, thereby reducing an overall weight of watersport board 100 relative to a configuration in which shell internal volume 121 is filled with the shell fill material alone. Additionally, and as discussed, watersport boards 100 according to the present disclosure may be more durable relative to a configuration in which shell internal volume 121 is at least substantially filled with infusion member material(s) 132 alone. For example, watersport boards 100 may be configured such that shell fill material 150 surrounds each infusion member 130. As another example, shell fill material 150 may be more durable than infusion member material 132 and/or infusion fill material 140 (when present). In such an embodiment, an impact force exerted on the watersport board may be less likely to damage elongate shell 120, infusion member 130, and/or infusion fill material 140 relative to a configuration that lacks the shell fill material.

Watersport board 100 may be characterized by a watersport board mass thereof, examples of which include at least 5 kilograms (kg), at least 10 kg, at least 15 kg, at least 20 kg, at most 25 kg, at most 23 kg, at most 20 kg, at most 18 kg, at most 15 kg, at most 13 kg, at most 10 kg, 5-15 kg, 10-20 kg, and/or 15-25 kg. Additionally or alternatively, watersport board 100 may be characterized by an extent to which a mass of the watersport board is less than a mass of an equivalent watersport board that does not include the at least one infusion member 130. For example, watersport board 100 may be characterized by a shell fill material mass that is the product of shell void volume 122 and a density of shell fill material 150, an infusion member material mass that is the product of infusion member volume 134 and an average density of infusion member material(s) 132, and a total internal mass that is the sum of the shell fill material mass and the infusion member material mass. Watersport board 100 may be configured such that the total internal mass is less than a product of shell internal volume 121 and the density of the shell fill material by a threshold proportion of the product of the shell internal volume and the density of the shell fill material. As more specific examples, the threshold proportion may be at least 10%, at least 15%, at least 20%, at least 25%, at least 30%, at least 35%, at least 40%, at least 45%, 10-20%, 15-25%, 20-30%, 25-35%, and/or 30-40%. Expressed in different terms, watersport board 100 may be at least 10%, at least 15%, at least 20%, at least 25%, at least 30%, at least 35%, at least 40%, at least 45%, 10-20%, 15-25%, 20-30%, 25-35%, and/or 30-40% lighter than an otherwise identical watersport board that includes additional shell fill material 150 instead of the at least one infusion member 130. As used herein, "average density" refers to a volumetric average density in which the densities of the individual components or materials being averaged are weighted by the percentage of the total volume formed or occupied by the corresponding components or materials.

Watersport board 100 may include any appropriate number of infusion members 130, such as one infusion member, two infusion members, three infusion members, or more than three infusion members. Infusion member(s) 130 may be positioned within shell internal volume 121 in any appropriate configuration, such as to enhance and/or maintain a balance characteristic of watersport board 100. For example, and as schematically illustrated in FIG. 1, infusion member(s) 130 may be positioned symmetrically with respect to shell longitudinal axis 102. Additionally, and as schematically illustrated in FIGS. 1-2, infusion member(s) 130 may be spaced apart from one or more components of elongate shell 120 within shell internal volume 121. For example, infusion member(s) 130 may be spaced apart from nose 104, tail 106, bottom 107, deck 108, and/or one or both rails 105 within shell internal volume 121. Stated differently, and as illustrated in FIG. 2, elongate shell 120 may include a shell inner surface 123 that defines and/or bounds shell internal volume 121, and infusion member(s) 130 may be spaced apart from the shell inner surface.

Shell void volume 122 and/or infusion member volume 134 respectively may occupy any suitable proportions of shell internal volume 121. For example, infusion member volume 134 may occupy a proportion of shell internal volume 121 that is sufficient to reduce the mass of watersport board 100 relative to that of an analogous watersport board that does not include infusion member(s) 130. As more specific examples, infusion member volume 134 may occupy at least 10%, at least 20%, at least 30%, at least 40%, at least 50%, at least 60%, at least 70%, at least 80%, at most 90%, at most 75%, at most 65%, at most 55%, at most 45%, at most 35%, at most 25%, at most 15%, 10-30%, 20-40%, 30-50%, 40-60%, 50-70%, and/or 60-80% of shell internal volume 121.

Each infusion member 130 may have any appropriate shape and/or size. In an embodiment in which infusion member 130 includes infusion sleeve 136 and infusion fill material 140, the size and/or shape of the infusion member may correspond to the size and/or shape of the infusion sleeve, such as when filled with the infusion fill material. For example, and as schematically illustrated in FIG. 1, each infusion member 130 may have an elongate dimension that is parallel, or at least substantially parallel, to shell longitudinal axis 102. However, this is not required, and it also is within the scope of the present disclosure that each infusion member 130 may have an elongate dimension that is parallel, or at least substantially parallel, to shell transverse axis 103.

Each infusion member 130 also may be characterized by a cross-sectional shape thereof. For example, each infusion member 130 may have an infusion member cross-sectional shape (such as a cross-sectional shape of infusion sleeve 136 when filled with infusion fill material 140, when the infusion member includes the infusion sleeve and the infusion fill material) that is circular, oval, elliptical, elongate and/or rectangular. When the infusion member 130 includes an infusion sleeve 136, the infusion sleeve may be flexible, resilient, pliable, and/or otherwise amorphous before being installed within watersport board 100 and/or being filled with infusion fill material 140, and may exhibit and/or assume a characteristic shape (such as the infusion member cross-sectional shape) only when substantially or fully filled with a material (such as infusion fill material 140). However, this is not required, and it is additionally within the scope of the present disclosure that infusion member 130 and/or infusion sleeve 136 may be rigid, or at least substantially rigid. The infusion member cross-sectional shape also may be characterized by an aspect ratio thereof. As examples, the infusion member cross-sectional shape may have an aspect ratio that is at least 1.25, at least 1.5, at least 2, at least 2.5, at least 3, at least 4, at most 5, at most 4.5, at most 3.5, at most 2.75, at most 2.25, and/or at most 1.75. Additionally or alternatively, the infusion member cross-sectional shape may have an elongate dimension that is perpendicular, or at least substantially perpendicular, to shell longitudinal axis 102, and/or that is parallel, or at least substantially parallel, to shell transverse axis 103.

When infusion member 130 includes an infusion sleeve 136, each infusion sleeve 136 may be formed of any appropriate material. As examples, infusion sleeve 136 may be formed of a plastic, a polymer, a resilient material, a flexible material, PU, a film, a PU film, a foil, and/or polyvinyl chloride (PVC). Infusion sleeve 136 may be formed of an infusion member material that is sufficiently lightweight that the infusion sleeve and infusion fill material 140 positioned therein collectively have a lower weight than an equivalent volume of shell fill material 150.

Each infusion sleeve 136, when present, may contain any appropriate infusion fill material 140. As examples, and as discussed, infusion fill material 140 may include and/or be a plastic, a polymer, a foam, and/or expanded polystyrene (EPS). In such an embodiment, infusion sleeve 136 may be an evacuated infusion sleeve 136 that is free, or at least substantially free, of air. Infusion fill material 140 also may include and/or be a plurality of infusion pellets of any appropriate size. As examples, each infusion pellet may have a diameter or other maximum dimension of at least 1 millimeter (mm), at least 3 mm, at least 5 mm, at least 10 mm, at least 15 mm, at least 20 mm, at least 25 mm, at least 30 mm, at most 35 mm, at most 27 mm, at most 22 mm, at most 17 mm, at most 12 mm, at most 7 mm, and/or at most 2 mm. Additionally or alternatively, infusion fill material 140 may include and/or be a gas, a pressurized gas, air, and/or pressurized air. In such an embodiment, infusion sleeve 136 also may be referred to as an inflatable infusion sleeve 136 and/or as an inflatable infusion member 130.

Figure 3:
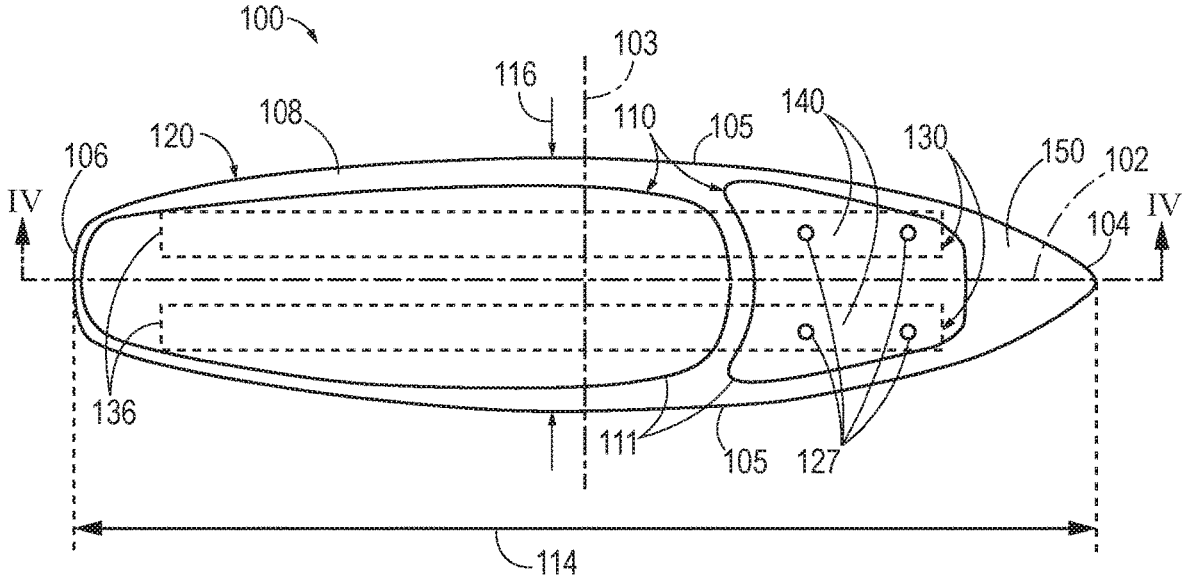
FIG. 3 is a top plan view of an example of a watersport board according to the present disclosure.
Figure 4:
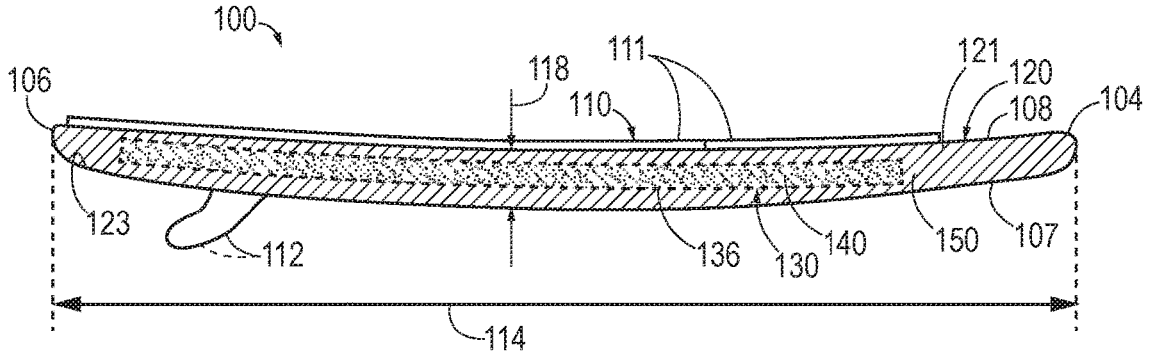
FIG. 4 is a side cross-sectional elevation view of the watersport board of FIG. 3 taken along line IV-IV in FIG. 3.

FIGS. 3-4 provide slightly less schematic representations of an example of watersport board 100 that includes two spaced-apart infusion members 130, each of which includes an infusion sleeve 136 filled with an infusion fill material 140. In the example of FIGS. 3-4, deck 108 is partially covered by deck pad 110 that includes two disconnected deck pad components 111. Additionally, in this example, each infusion member 130 is spaced apart from nose 104, tail 106, and each rail 105 of elongate shell 120, such that shell fill material 150 (illustrated by hash marks in FIG. 4) surrounds the infusion members. FIGS. 3-4 further illustrate an embodiment of watersport board 100 that includes at least one fin 112 extending from bottom 107 of elongate shell 120 (shown in FIG. 4), as well as a plurality of accessory mounts 127 positioned in and/or on deck pad 110 (shown in FIG. 3).

As illustrated in FIGS. 3-4, watersport board 100 may have a length, a width, and/or a thickness that varies across a respective extent of the watersport board. Hence, as used herein, and as illustrated in FIGS. 3-4, board length 114 may refer to a maximum length of watersport board 100, as measured in a direction parallel to board longitudinal axis 102, board width 116 may refer to a maximum width of the watersport board, as measured in a direction parallel to board transverse axis 103, and/or board thickness 118 may refer to a maximum thickness of the watersport board, as measured in a direction perpendicular to each of the board longitudinal axis and the board transverse axis.

Figure 5:
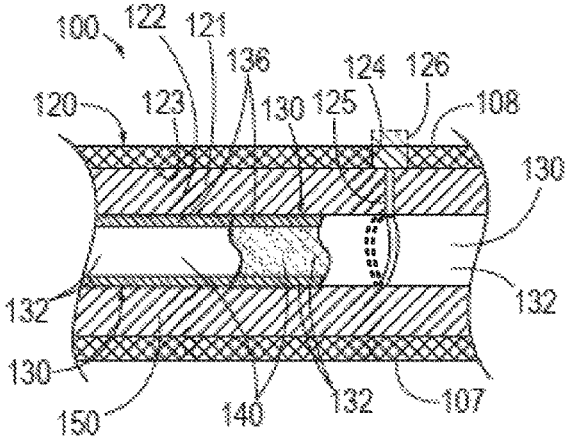
FIG. 5 is a schematic fragmentary partial cross-sectional elevation view of an example of a watersport board according to the present disclosure.
Figure 6:
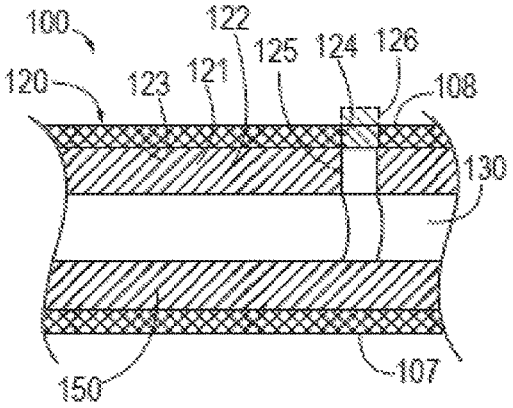
FIG. 6 is a schematic fragmentary partial cross-sectional elevation view of an example of a watersport board according to the present disclosure.

FIGS. 5-8 illustrate examples of watersport boards 100 that include infusion member retention structure 125. The examples of infusion member retention structure 125 shown in FIGS. 5-8 may be utilized with any of the watersport boards disclosed herein, including the watersport boards of FIGS. 1-4. In the examples of FIGS. 5-6, infusion member retention structure 125 is coupled to and extends from shell plug 126, which is received within infusion member port 124.

FIG. 5 is a schematic cross-sectional side view of a portion of an example of watersport board 100 that includes infusion member retention structure 125 in the form of a loop (such as a plastic loop, a wire loop, a rope loop, and/or a string loop) that extends into shell internal volume 121 from shell plug 126 and supports infusion member 130 relative to the shell internal volume. Specifically, in the embodiment of FIG. 5, infusion member retention structure 125 circumferentially wraps around and supports infusion member 130 within shell internal volume 121. In such an embodiment, infusion member retention structure 125 may be described as being amorphous, as conforming to a surface and/or shape of infusion member 130, as having a variable opening size, and/or as non-rigidly supporting infusion member 130. Stated differently, in an embodiment of watersport board 100 that includes infusion member retention structure 125 in the form of a loop, the infusion member retention structure may support infusion member 130 in such a manner that the infusion member retention structure does not substantially restrict translation and/or rotation of the infusion member within shell internal volume 121. That is, infusion member retention structure 125 may bend, flex, translate, and/or collapse while coupled to infusion member 130 and/or shell plug 126 unless otherwise restricted, such as by a densely-packed, cured, and/or solidified shell fill material 150.

FIG. 5 further illustrates a plurality of examples of infusion member 130. Specifically, as schematically illustrated in the center and left-hand cross-sectional cutaways in FIG. 5, infusion member 130 may include infusion sleeve 136 filled with infusion fill material 140. More specifically, the center cross-sectional cutaway illustrates infusion sleeve 136 filled with infusion fill material 140 in the form of a plurality of infusion pellets, while the left-hand cross-sectional cutaway schematically illustrates the infusion sleeve filled with the infusion fill material in the form of a pressurized gas. As schematically illustrated in the right-hand cutaway in FIG. 5, infusion member 130 may be a solid infusion member and/or may include a single infusion member material 132. Thus, FIG. 5 illustrates a variety of examples of constructions for infusion member 130. In each example, the infusion member 130 (and/or infusion sleeve 136) has an exterior surface that faces the shell void volume 122 and which may be in contact with the shell fill material.

FIG. 6 is a schematic cross-sectional side view of a portion of an example of watersport board 100 that includes infusion member retention structure 125 in the form of a rigid collar that circumferentially encloses and supports infusion member 130 within shell internal volume 121. In such an embodiment, infusion member retention structure 125 may be described as having a fixed and/or rigid structure, a fixed and/or rigid shape, and/or a fixed opening size, such as may be configured to receive infusion member 130 therein. Stated differently, in an embodiment of watersport board 100 that includes infusion member retention structure 125 in the form of a rigid collar, the infusion member retention structure may support infusion member 130 in such a manner that the infusion member retention structure substantially restricts translation and/or rotation of the infusion sleeve within shell internal volume 121. In such an embodiment, infusion member retention structure 125 may have a fixed opening size and/or a rigid shape that closely conforms to a shape and/or size of infusion member 130, or may be oversized with respect to the infusion member, such as to facilitate positioning of the infusion member within the infusion member retention structure.

In the examples of FIGS. 5-6, infusion member retention structure 125 may be coupled to infusion member 130 and/or to shell plug 126 in any appropriate manner and/or order. For example, infusion member retention structure 125 may be coupled to infusion member 130 prior to the infusion sleeve being inserted into shell internal volume 121 and/or prior to the infusion member retention structure being coupled to shell plug 126. As a more specific example, infusion member retention structure 125 may be an amorphous infusion member retention structure that is wrapped around and/or tied to infusion member 130 prior to the infusion member being inserted into shell internal volume 121, and may be located by a user via infusion member port 124 and coupled to shell plug 126 after the infusion member is inserted into the shell internal volume. As another example, infusion member retention structure 125 may be an amorphous infusion member retention structure that is looped around and/or tied to infusion member 130 via infusion member port 124 subsequent to the infusion member being inserted into shell internal volume 121 and prior to coupling the infusion member retention structure to shell plug 126. As yet another example, infusion member retention structure 125 may be a rigid infusion member retention structure that extends into shell internal volume 121 (such as from shell plug 126) prior to infusion member 130 being inserted into the shell internal volume, and inserting the infusion member into the shell internal volume may include inserting the infusion member into the infusion member retention structure. When the infusion member includes an infusion sleeve 136, the coupling infusion member retention structure 125 to infusion member 130 may be performed prior to or subsequent to filling the infusion sleeve with infusion fill material 140, may be performed prior to or subsequent to filling shell void volume 122 with shell fill material 150, and/or may be performed prior to or subsequent to curing and/or otherwise solidifying the shell fill material within the shell void volume.

Figure 7:
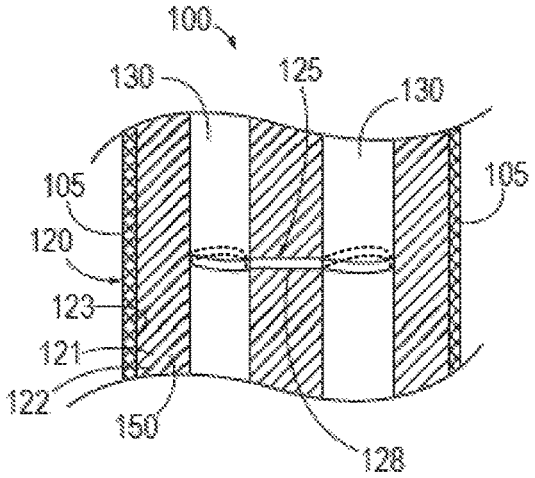
FIG. 7 is a schematic fragmentary partial cross-sectional plan view of an example of a watersport board according to the present disclosure.

FIG. 7 is a schematic cross-sectional top view of a portion of an example of watersport board 100 that includes a pair of infusion members 130 coupled to one another by infusion member retention structure 125 that includes a connecting bar, or connecting member, 128. In such an embodiment, infusion member retention structure 125 may be coupled to each infusion member 130 in any appropriate manner, such as by circumferentially enclosing, or at least substantially circumferentially enclosing, each infusion member 130 with a loop and/or a collar. For example, infusion member retention structure 125 may include one or more amorphous coupling structures that may be described as conforming to a surface and/or shape of infusion member 130, as having a variable opening size, and/or as non-rigidly supporting infusion member 130. Additionally or alternatively, infusion member retention structure 125 may include one or more rigid coupling structures that may be described as having a fixed and/or rigid structure, a fixed and/or rigid shape, and/or a fixed opening size, such as may be configured to receive infusion member 130 therein. In an embodiment in which infusion member retention structure 125 includes connecting member 128, infusion member retention structure 125 may be configured to maintain each infusion member 130 at a fixed and/or consistent separation distance from one another along a length of each infusion member, and/or to maintain each infusion member in a spaced-apart orientation with respect to shell inner surface 123.

In an embodiment in which infusion member retention structure 125 includes connecting member 128, the infusion member retention structure may be coupled to each infusion member 130, to elongate shell 120, and/or to shell plug 126 in any appropriate manner and/or order. For example, infusion member retention structure 125 may be coupled to each infusion member 130 prior to the infusion members being inserted into shell internal volume 121. As a more specific example, infusion member retention structure 125 may be an amorphous infusion member retention structure that is wrapped around and/or tied to each infusion member 130 prior to the infusion member being inserted into shell internal volume 121. As another example, infusion member retention structure 125 may be an amorphous infusion member retention structure that is looped around and/or tied to each infusion member 130 via infusion member port 124 subsequent to the infusion members being inserted into shell internal volume 121. As yet another example, infusion member retention structure 125 may be a rigid infusion member retention structure that extends into shell internal volume 121 (such as from shell plug 126) prior to infusion members 130 being inserted into the shell internal volume, and inserting the infusion members into the shell internal volume may include inserting each infusion member into the infusion member retention structure. When the infusion member 130 includes an infusion sleeve 136, the coupling infusion member retention structure 125 to each infusion member 130 may be performed prior to or subsequent to filling the infusion sleeve with infusion fill material 140. It is additionally within the scope of the present disclosure that watersport board 100 may include any appropriate combination of flexible/amorphous infusion member retention structures 125, rigid infusion member retention structures 125, and/or infusion member retention structures 125 that include connecting members 128.

Figure 8:
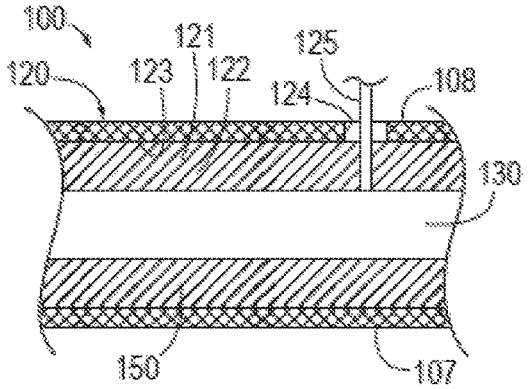
FIG. 8 is a schematic fragmentary partial cross-sectional elevation view of an example of a watersport board according to the present disclosure.

FIG. 8 is a schematic cross-sectional side view of a portion of an example of watersport board 100 that includes infusion member retention structure 125 in the form of a fixture that extends through infusion member port 124 from an exterior side of elongate shell 120 to infusion member 130. FIG. 8 may be described as illustrating a portion of watersport board 100 during manufacture of the watersport board. For example, FIG. 8 may be described as illustrating a manufacturing step that includes provisionally retaining infusion member 130 in a spaced-apart orientation with respect to shell inner surface 123 prior to filling shell void volume 122 with shell fill material 150 to fix the orientation of the infusion member within shell internal volume 121. As a more specific example, such a manufacturing step may include, subsequent to positioning infusion member 130 within shell internal volume 121 and prior to filling shell void volume 122 with shell fill material 150 and/or prior to curing the shell fill material, inserting infusion member retention structure 125 through infusion member port 124 and affixing the infusion member retention structure to the infusion member. In such an example, the affixing infusion member retention structure 125 to infusion member 130 may be performed in any appropriate manner, such as by tacking, gluing, welding, tying, wrapping, and/or at least partially inserting the infusion member retention structure into the infusion member. In the embodiment of FIG. 8, infusion member retention structure 125 may be configured to be selectively uncoupled from infusion member 130 prior to sealing infusion member port 124, or may be configured to be selectively severed and/or shortened while coupled to the infusion member to permit the infusion member port to be sealed after shell fill material 150 is inserted into shell internal volume 121 and cured or otherwise solidified.

Figure 9:
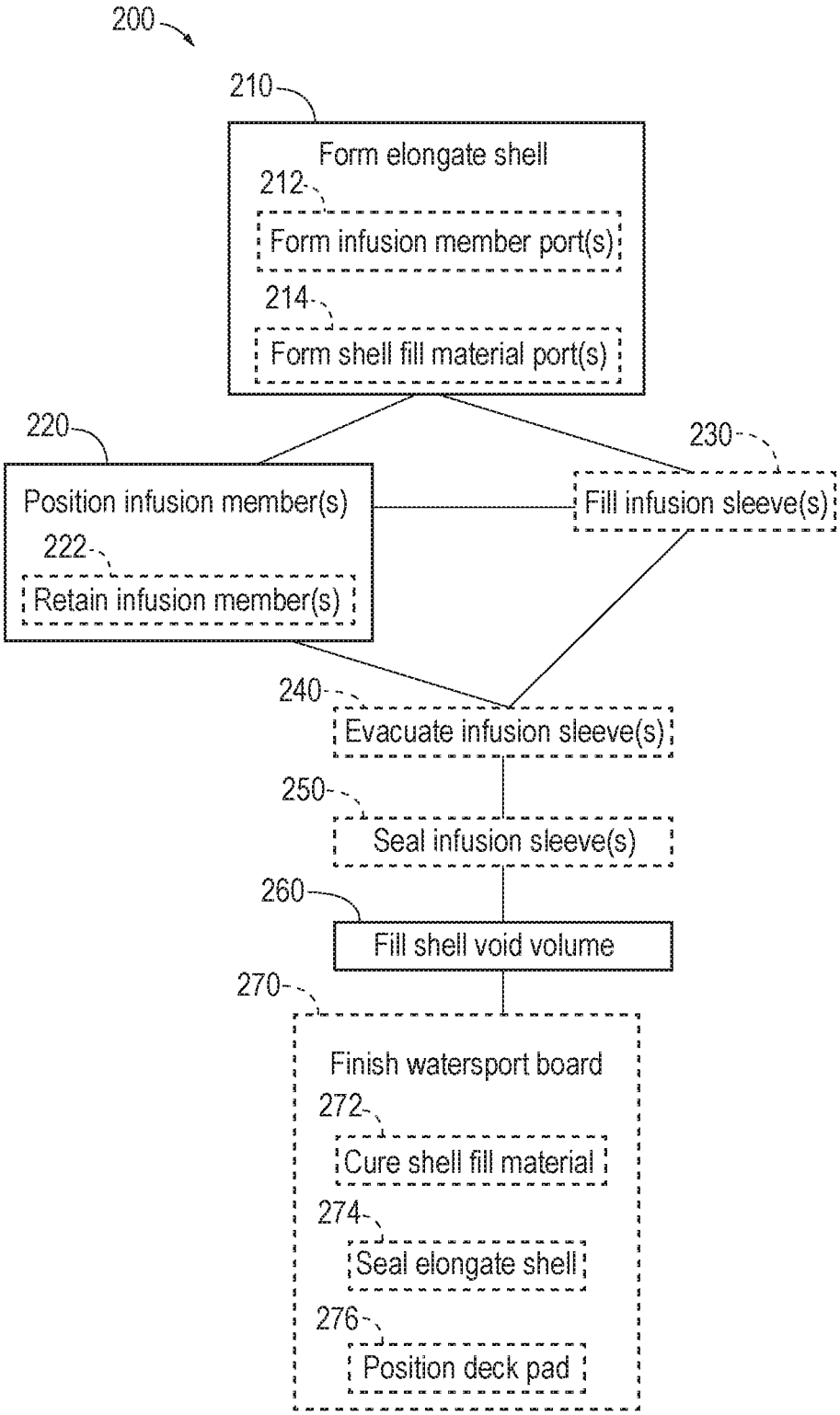
FIG. 9 is a flow chart illustrating examples of methods for forming watersport boards according to the present disclosure.

FIG. 9 provides examples of methods 200 for forming watersport boards 100 according to the present disclosure. The methods presented in FIG. 9 are not intended to be exhaustive or required for production of all watersport boards 100 according to the present disclosure. Similarly, methods 200 may include additional steps and/or substeps without departing from the scope of the present disclosure. Unless a particular step must be completed to enable a subsequent step to be performed, the examples of steps shown and/or discussed in connection with FIG. 9 may be performed in any suitable concurrent and/or sequential order. In the following discussion, reference numerals for the previously discussed watersport boards 100 and components thereof are utilized to provide references to the structures shown and discussed with respect to FIGS. 1-8 even though these reference numerals are not shown in FIG. 9.

As illustrated in FIG. 9, methods 200 of forming watersport boards 100 according to the present disclosure include forming 210 elongate shell 120 that defines shell internal volume 121 and subsequently positioning 220 at least one infusion member 130 within the shell internal volume, thereby separating the shell internal volume into infusion member volume 134 and shell void volume 122. Methods 200 further include filling 260 shell void volume 122 with shell fill material 150.

The forming 210 elongate shell 120 may be performed in any appropriate manner, such as may be known to the watersport board industry, examples of which include blow molding, roto-molding, and/or thermoforming. As an example, the forming 210 may include introducing a parison of molten material into a mold cavity and utilizing a pressurized gas, such as air, to force the molten material against an internal surface of the mold cavity to form elongate shell 120 having a shape defined by the internal surface of the mold cavity. In such an example, the forming 210 further may include cooling elongate shell 120, removing the elongate shell from the mold cavity, and/or removing excess material from the elongate shell. As an additional example, the forming 210 may include forming an upper portion of elongate shell 120, forming a lower portion of the elongate shell, and coupling the upper portion of the elongate shell to the lower portion of the elongate shell to define shell internal volume 121.

As illustrated in FIG. 9, the forming 210 further may include forming 212 at least one infusion member port 124 defined by elongate shell 120 and configured to permit access to shell internal volume 121 from external the elongate shell, and/or may include forming 214 at least one shell fill material port 152 (such as schematically illustrated in FIG. 1) defined by the elongate shell and configured to permit access to the shell internal volume from external the elongate shell. Infusion member port 124 may be configured to receive infusion member 130 and/or infusion member retention structure 125, whereas shell fill material port 152 may be configured such that the filling 260 shell void volume 122 with shell fill material 150 includes flowing the shell fill material into the shell void volume via the shell fill material port. Infusion member port 124 may be larger than shell fill material port 152, such as to accommodate one or more infusion members 130. The forming 212 and the forming 214 may include forming infusion member port(s) 124 and/or shell fill material port(s) 152 in any appropriate portion of elongate shell 120, such as on an upper surface thereof and/or in deck 108.

The positioning 220 the at least one infusion member 130 may be performed in any appropriate manner. For example, and as discussed, the positioning 220 may include inserting each infusion member 130 into shell internal volume 121 via infusion member port 124, and further may include inserting the infusion member into the shell internal volume such that the infusion member extends between a pair of opposed infusion member ports and through the internal volume.

As illustrated in FIG. 9, and as discussed, the positioning 220 additionally may include retaining 222 each infusion member 130 in a fixed, or at least substantially fixed, orientation with respect to elongate shell 120. As an example, when infusion member 130 extends between a pair of opposed infusion member ports 124 and through shell internal volume 121, the retaining 222 may include tensioning the infusion member between the pair of opposed infusion member ports. Additionally or alternatively, and as discussed, the retaining 222 may include engaging each infusion member 130 with at least one infusion member retention structure 125, such as to support the infusion member within shell internal volume 121 such that the infusion member is spaced apart from shell inner surface 123.

As illustrated in FIG. 9, when the at least one infusion member 130 includes at least one infusion sleeve 136, methods 200 additionally may include, prior to the filling 260 shell void volume 122 with shell fill material 150, filling 230 the at least one infusion sleeve 136 with infusion fill material 140. The filling 230 may be performed prior to the positioning 220 or subsequent to the positioning 220. The filling 230 may be performed in any appropriate manner, such as by flowing infusion fill material 140 into an end region of infusion sleeve 136. As an example, the positioning 220 may include positioning each infusion sleeve 136 such that a portion (such as an end region) of the infusion sleeve remains positioned external to shell internal volume 121, such as to facilitate subsequently filling 230 the infusion sleeve with infusion fill material 140 via the end region positioned external to the shell internal volume. Additionally or alternatively, the filling 230 may include flowing infusion fill material 140 into infusion sleeve 136 via infusion member port 124.

In an embodiment of methods 200 in which the positioning 220 is performed prior to the filling 230, infusion sleeve 136 may be described as a hollow infusion sleeve 136 and/or a hollow infusion member 130 prior to and/or while it is being positioned within shell internal volume 121. Alternatively, in an embodiment of methods 200 in which the filling 230 is performed prior to the positioning 220, infusion sleeve 136 may be described as a pre-filled infusion sleeve 136 and/or a pre-filled infusion member 130 prior to and/or while it is being positioned within shell internal volume 121. As an example, pre-filled infusion sleeve 136 may be at least substantially rigid and/or filled with a pressurized gas.

As further illustrated in FIG. 9, when the at least one infusion member 130 includes at least one infusion sleeve 136, methods 200 may include, subsequent to the positioning 220 and/or to the filling 230 and prior to the filling 260, evacuating 240 infusion sleeve(s) 136 of air. As an example, in an embodiment in which infusion fill material 140 includes a plurality of infusion pellets, evacuating infusion sleeve 136 of air may yield an infusion sleeve that is more rigid, such as may facilitate maintaining the infusion sleeve in a fixed, or at least substantially fixed, orientation with respect to shell internal volume 121. The evacuating 240 may be performed in any appropriate manner, such as by applying a vacuum to the interior of infusion sleeves 136. As a more specific example, the applying the vacuum to the interior of infusion sleeve 136 may include connecting infusion sleeve 136 to a vacuum source via infusion member port 124, such as via an infusion member port that is different than an infusion member port through which infusion fill material 140 is inserted into the infusion sleeve during the filling 230.

With continued reference to FIG. 9, when the at least one infusion member 130 includes at least one infusion sleeve 136, methods 200 further may include, subsequent to the filling 230, sealing 250 infusion sleeve(s) 136. The sealing 250 may restrict infusion fill material 140 from escaping infusion sleeve 136 and/or may restrict a foreign material (such as shell fill material 150) from entering infusion sleeve 136. Additionally, the sealing 250 may include positioning each infusion sleeve 136 such that the infusion sleeve is fully received within shell internal volume 121, and/or such that the infusion sleeve is coupled to shell plug 126 (such as via infusion member retention structure 125). While FIG. 9 illustrates the sealing 250 as being performed subsequent to the evacuating 240, this is not required, and it is within the scope of the present disclosure that the sealing 250 may be performed prior to the evacuating 240. In such an embodiment, the evacuating 240 may include connecting infusion sleeve 136 to the vacuum source via a one-way valve.

The filling 260 shell void volume 122 with shell fill material 150 may be performed in any appropriate manner. As an example, and as discussed, the filling 260 may include surrounding each infusion member 130 with shell fill material 150 such that the infusion member 130 is spaced apart from shell inner surface 123 by the shell fill material. Additionally, the filling 260 may include flowing shell fill material 150 into shell void volume 122 via shell fill material port 152, and further may include overfilling the shell void volume such that the shell fill material fills the shell void volume and exits shell internal volume 121 via infusion member port 124 and/or a different shell fill material port.

As illustrated in FIG. 9, methods 200 further may include one or more steps for finishing 270 watersport board 100. As an example, the finishing 270 may include, subsequent to the filling 260, curing 272 shell fill material 150 to solidify the shell fill material and/or to lock each infusion member 130 in place relative to elongate shell 120. The curing 272 may be performed in any appropriate manner, such as via an application of heat and/or ultraviolet radiation and/or via a passage of time. As an additional example, the finishing 270 may include, subsequent to the positioning 220, sealing 274 elongate shell 120 such that shell internal volume 121 is watertight. As a more specific example, the sealing 274 may include sealing each infusion member port 124 and/or each shell fill material port 152, such as with a corresponding shell plug 126. In some embodiments, shell plug 126 may include accessory mount 127, such that the sealing 274 additionally may include installing one or more accessory mounts. Additionally or alternatively, the finishing 270 may include, subsequent to the sealing 274, positioning 276 at least one deck pad component 111 on a top surface of elongate shell 120. The positioning 276 may include positioning the at least one deck pad component 111 to cover each infusion member port 124 and/or each shell fill material port 152.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Examples of watersport boards according to the present disclosure and methods for forming watersport boards according to the present disclosure are presented in the following enumerated paragraphs.

A1. A watersport board configured to operate upon a body of water, the watersport board comprising:

an elongate shell that defines a shell internal volume of the watersport board;

at least one infusion member within the shell internal volume and defining an infusion member volume, such that the shell internal volume is separated by the at least one infusion member into the infusion member volume and a shell void volume; and a shell fill material positioned within the shell void volume.

A2. The watersport board of paragraph A1, wherein the shell void volume and the infusion member volume collectively occupy at least 95% of the shell internal volume.

A3. The watersport board of any of paragraphs A1-A2, wherein the shell fill material occupies at least one of at least 75%, at least 80%, at least 85%, at least 90%, at least 95%, at least 99%, and 100% of the shell void volume.

A4. The watersport board of any of paragraphs A1-A3, wherein the infusion member volume occupies a proportion of the shell internal volume that is at least one of at least 10%, at least 20%, at least 30%, at least 40%, at least 50%, at least 60%, at least 70%, at least 80%, at most 90%, at most 75%, at most 65%, at most 55%, at most 45%, at most 35%, at most 25%, at most 15%, 10-30%, 20-40%, 30-50%, 40-60%, 50-70%, and 60-80% of the shell internal volume.

A5. The watersport board of any of paragraphs A1-A4, wherein the elongate shell has a shell longitudinal axis such that the elongate shell is symmetric, or at least substantially symmetric, with respect to the shell longitudinal axis.

A6. The watersport board of paragraph A5, wherein the at least one infusion member(s) is/are positioned symmetrically with respect to the shell longitudinal axis.

A7. The watersport board of any of paragraphs A1-A6, wherein the elongate shell has a shell transverse axis that is perpendicular, or at least substantially perpendicular, to a/the shell longitudinal axis, and wherein each infusion member of the at least one infusion member extends in a direction parallel to the shell transverse axis.

A8. The watersport board of any of paragraphs A1-A7, wherein the elongate shell includes a nose, a tail, a left rail, a right rail, a bottom, and a deck, wherein each of the left rail and the right rail extends between the nose and the tail, wherein the deck extends between the nose and the tail and between the left rail and the right rail, and wherein the bottom at least partially defines an underside of the watersport board.

A9. The watersport board of paragraph A8, wherein the deck is configured to support a user standing upon the deck when the watersport board operates upon the body of water.

A10. The watersport board of any of paragraphs A8-A9, wherein the at least one infusion member is spaced apart from at least one, and optionally both, of the nose and the tail within the shell internal volume.

A11. The watersport board of any of paragraphs A8-A10, wherein the at least one infusion member is spaced apart from each of the left rail and the right rail within the shell internal volume.

A12. The watersport board of any of paragraphs A8-A11, wherein the at least one infusion member is spaced apart from each of the deck and the bottom of the elongate shell.

A13. The watersport board of any of paragraphs A1-A12, wherein the elongate shell includes a shell inner surface that defines the shell internal volume, and wherein the at least one infusion member is spaced apart from the shell inner surface.

A14. The watersport board of any of paragraphs A1-A13, when dependent from paragraph A8, wherein the watersport board further includes a deck pad with at least one deck pad component positioned on at least a portion of the deck, wherein each deck pad component has a coefficient of static friction against a user's bare foot that is greater than a coefficient of static friction between the deck and the user's bare foot.

A15. The watersport board of any of paragraphs A1-A14, when dependent from paragraph A8, wherein the watersport board has a board length, as measured in a direction parallel to a/the shell longitudinal axis between the nose and the tail, and wherein the board length is at least one of at least 1 meter (m), at least 2 m, at least 3 m, at least 4 m, at most 5 m, at most 3.5 m, at most 2.5 m, and at most 1.5 m.

A16. The watersport board of any of paragraphs A1-A15, when dependent from paragraph A8, wherein the watersport board has a board width, as measured between the left rail and the right rail and in a direction parallel to a/the shell transverse axis perpendicular to a/the shell longitudinal axis and parallel to the deck, and wherein the board width is at least one of at least 0.25 m, at least 0.5 m, at least 0.75 m, at least 1 m, at least 1.5 m, at most 2 m, at most 1.75 m, at most 1.25 m, at most 0.8 m, at most 0.6 m, and at most 0.3 m.

A17. The watersport board of any of paragraphs A1-A16, wherein the watersport board has a maximum board thickness, as measured in a direction perpendicular to each of a/the shell transverse axis and a/the shell longitudinal axis, and wherein the maximum board thickness is at least one of at least 5 centimeters (cm), at least 10 cm, at least 20 cm, at least 30 cm, at least 40 cm, at most 45 cm, at most 35 cm, at most 25 cm, at most 15 cm, and at most 7 cm.

A18. The watersport board of any of paragraphs A1-A17, wherein the watersport board has a watersport board mass, and wherein the watersport board mass is at least one of at least 5 kilograms (kg), at least 10 kg, at least 15 kg, at least 20 kg, at most 25 kg, at most 23 kg, at most 20 kg, at most 18 kg, at most 15 kg, at most 13 kg, at most 10 kg, 5-15 kg, 10-20 kg, and 15-25 kg.

A19. The watersport board of any of paragraphs A1-A18, when dependent from paragraph A8, wherein the watersport board further includes at least one fin configured to extend from the bottom of the elongate shell into the body of water when the watersport board operates upon the body of water to stabilize the watersport board in the body of water.

A20. The watersport board of paragraph A19, wherein the watersport board includes one fin, two fins, three fins, or more than three fins.

A21. The watersport board of any of paragraphs A1-A20, wherein the elongate shell is formed of high-density polyethylene (HDPE).

A22. The watersport board of any of paragraphs A1-A21, wherein the at least one infusion member is one infusion member, two infusion members, three infusion members, or more than three infusion members.

A23. The watersport board of any of paragraphs A1-A22, wherein the at least one infusion member is formed from at least one infusion member material.

A23.1 The watersport board of any of paragraphs A1-A23, wherein the at least one infusion member is formed from a single infusion member material.

A23.2 The watersport board of any of paragraphs A1-A23, wherein the at least one infusion member is formed from at least two different infusion member materials.

A24. The watersport board of any of paragraphs A1-A23.2, wherein at least one infusion member includes an infusion sleeve that defines an infusion sleeve internal volume, and wherein the infusion member further includes an infusion fill material positioned within the infusion sleeve internal volume.

A25. The watersport board of any of paragraphs A1-A24, wherein each infusion member is rigid.

A26. The watersport board of any of paragraphs A1-A25, wherein each infusion member is at least one of flexible, resilient, and pliable.

A27. The watersport board of any of paragraphs A1-A26, wherein each infusion member has an infusion member cross-sectional shape, and wherein the infusion member cross-sectional shape is at least one of circular, oval, elliptical, elongate, and rectangular.

A28. The watersport board of paragraph A27, when dependent from paragraph A24, wherein the infusion sleeve has the infusion member cross-sectional shape when filled with the infusion fill material.

A29. The watersport board of any of paragraphs A27-A28, wherein the infusion member cross-sectional shape of each infusion member has an aspect ratio that is at least one of at least 1.25, at least 1.5, at least 2, at least 2.5, at least 3, at least 4, at most 5, at most 4.5, at most 3.5, at most 2.75, at most 2.25, and at most 1.75.

A30. The watersport board of any of paragraphs A27-A29, wherein a/the infusion member cross-sectional shape has an elongate dimension that is perpendicular, or at least substantially perpendicular, to a/the shell longitudinal axis.

A31. The watersport board of any of paragraphs A27-A30, wherein a/the infusion member cross-sectional shape has a/the elongate dimension that is parallel, or at least substantially parallel, to a/the shell transverse axis.

A32. The watersport board of any of paragraphs A1-A31, wherein each infusion member has an/the elongate dimension that is parallel, or at least substantially parallel, to a/the shell longitudinal axis.

A33. The watersport board of any of paragraphs A1-A31, wherein each infusion member has an/the elongate dimension that is parallel, or at least substantially parallel, to a/the shell transverse axis.

A34. The watersport board of any of paragraphs A1-A33, when dependent from paragraph A24, wherein each infusion sleeve is an evacuated infusion sleeve that is free, or at least substantially free, of air.

A35. The watersport board of any of paragraphs A1-A34, wherein the at least one infusion member is at least partially formed from a/the infusion member material that includes at least one of a plastic, a polymer, a resilient material, a flexible material, polyurethane (PU), a film, a PU film, a foil, and polyvinyl chloride (PVC).

A36. The watersport board of any of paragraphs A1-A35, wherein the watersport board further includes at least one infusion member retention structure operatively coupled to at least one infusion member and configured to retain the at least one infusion member to which the at least one infusion member retention structure is coupled in a fixed, or at least substantially fixed, orientation with respect to at least one of the shell internal volume and at least one other infusion member.

A37. The watersport board of paragraph A36, wherein the at least one infusion member retention structure includes at least one of a loop, a plastic loop, a wire loop, a rope, a string, a collar, a rigid collar, and a bar.

A38. The watersport board of any of paragraphs A36-A37, wherein the at least one infusion member retention structure is a non-rigid infusion member retention structure configured to conform to a surface of the at least one infusion member to which it is coupled.

A39. The watersport board of any of paragraphs A36-A38, wherein the at least one infusion member retention structure is a rigid infusion member retention structure with a fixed opening size.

A40. The watersport board of any of paragraphs A36-A39, wherein the at least one infusion member retention structure includes a connecting member that extends between and operatively couples at least two infusion members.

A41. The watersport board of any of paragraphs A36-A40, wherein the at least one infusion member retention structure at least one of is coupled to and forms a portion of a shell plug that extends at least partially through the elongate shell.

A42. The watersport board of any of paragraphs A1-A41, when dependent from paragraph A24, wherein the infusion fill material is less dense than the shell fill material.

A43. The watersport board of paragraph A42, wherein the watersport board has a shell fill material mass that is the product of the shell void volume and a density of the shell fill material, an infusion member material mass that is the product of the infusion member volume and an average density of the at least one infusion member material, and a total internal mass that is the sum of the shell fill material mass and the infusion member material mass, and wherein the total internal mass is less than a product of the shell internal volume and the density of the shell fill material by at least one of at least 10%, at least 15%, at least 20%, at least 25%, at least 30%, at least 35%, at least 40%, at least 45%, 10-20%, 15-25%, 20-30%, 25-35%, and 30-40%.

A44. The watersport board of any of paragraphs A1-A43, when dependent from paragraph A24, wherein the infusion fill material includes at least one of a plastic, a polymer, a foam, expanded polystyrene (EPS), a gas, a pressurized gas, air, and pressurized air.

A45. The watersport board of any of paragraphs A1-A44, when dependent from paragraph A24, wherein the infusion fill material includes a plurality of infusion pellets.

A46. The watersport board of paragraph A45, wherein each infusion pellet of the plurality of infusion pellets has a maximum dimension that is at least one of at least 1 millimeter (mm), at least 3 mm, at least 5 mm, at least 10 mm, at least 15 mm, at least 20 mm, at least 25 mm, at least 30 mm, at most 35 mm, at most 27 mm, at most 22 mm, at most 17 mm, at most 12 mm, at most 7 mm, and at most 2 mm.

A47. The watersport board of any of paragraphs A1-A46, wherein the shell fill material includes at least one of a plastic, a polymer, a foam, and polyurethane.

A48. The watersport board of any of paragraphs A1-A47, when dependent from paragraph A24, wherein the shell fill material is more durable than the infusion fill material.

A49. The watersport board of any of paragraphs A1-A48, wherein the shell fill material surrounds the at least one infusion member.

A50. The watersport board of any of paragraphs A1-A49, wherein the at least one infusion member has a mass that is at least 20% less than a mass of a volume of the shell fill material that is equal to the infusion member volume.

B1. A method of forming a watersport board, the method comprising:

forming an elongate shell that defines a shell internal volume of the watersport board;

positioning at least one infusion member within the shell internal volume, wherein the at least one infusion member collectively defines an infusion member volume, such that the shell internal volume is separated by the at least one infusion member into the infusion member volume and a shell void volume; and filling the shell void volume with a shell fill material.

B2. The method of paragraph B1, wherein the forming the elongate shell includes at least one of blow molding, rotomolding, and thermoforming.

B3. The method of any of paragraphs B1-B2, wherein the forming the elongate shell includes forming an upper portion of the elongate shell, forming a lower portion of the elongate shell, and coupling the upper portion of the elongate shell to the lower portion of the elongate shell to define the shell internal volume.

B4. The method of any of paragraphs B1-B3, wherein the forming the elongate shell further includes forming at least one infusion member port defined by the elongate shell and configured to permit access to the shell internal volume from external the elongate shell.

B5. The method of any of paragraphs B1-B4, wherein the forming the elongate shell further includes forming at least one shell fill material port defined by the elongate shell and configured to permit access to the shell internal volume from external the elongate shell, and wherein the filling the shell void volume with the shell fill material includes flowing the shell fill material into the shell void volume via the at least one shell fill material port.

B6. The method of any of paragraphs B1-B5, when dependent from paragraph B4, wherein the positioning the at least one infusion member within the shell internal volume includes inserting each infusion member into the shell internal volume via the at least one infusion member port.

B7. The method of any of paragraphs B1-B6, wherein the positioning the at least one infusion member within the shell internal volume includes retaining each infusion member in a fixed, or at least substantially fixed, orientation with respect to the elongate shell.

B8. The method of any of paragraphs B1-B7, when dependent from paragraph B4, wherein the positioning the at least one infusion member includes inserting each infusion member into the shell internal volume such that each infusion member extends between a pair of opposed infusion member ports and through the internal volume.

B9. The method of paragraph B8, when dependent from paragraph B7, wherein the retaining each infusion member includes tensioning each infusion member between the pair of opposed infusion member ports.

B10. The method of any of paragraphs B1-B9, when dependent from paragraph B4, wherein the positioning the at least one infusion member includes inserting each infusion member into the shell internal volume such that the infusion member extends through one infusion member port.

B11. The method of any of paragraphs B1-B10, wherein the positioning the at least one infusion member includes positioning such that a portion of the at least one infusion member remains positioned external to the shell internal volume.

B12. The method of any of paragraphs B1-B11, when dependent from paragraph B7, wherein the retaining each infusion member includes engaging each infusion member with at least one infusion member retention structure.

B13. The method of paragraph B12, wherein the at least one infusion member retention structure at least one of is coupled to and forms a portion of a shell plug that extends at least partially through the elongate shell.

B14. The method of any of paragraphs B12-B13, wherein the at least one infusion member retention structure includes a loop that extends into the shell internal volume from at least one shell plug and supports the infusion member relative to the shell internal volume.

B15. The method of any of paragraphs B12-B14, wherein the at least one infusion member retention structure is defined by the elongate shell.

B16. The method of any of paragraphs B12-B15, wherein the at least one infusion member retention structure includes a fixture that is inserted into the shell internal volume via a/the at least one infusion member port and coupled to a corresponding infusion member.

B17. The method of any of paragraphs B12-B16, wherein the infusion member retention structure engages at least two infusion members.

B18. The method of any of paragraphs B12-B17, wherein the engaging each infusion member with the at least one infusion member retention structure includes coupling at least one infusion member retention structure to a corresponding infusion member prior to positioning the corresponding infusion member within the shell internal volume.

B19. The method of any of paragraphs B12-B18, wherein the engaging each infusion member with the at least one infusion member retention structure includes coupling at least one infusion member retention structure to a/the corresponding infusion member subsequent to positioning the corresponding infusion member within the shell internal volume.

B20. The method of any of paragraphs B12-B19, wherein the engaging each infusion member with the at least one infusion member retention structure includes coupling at least one infusion member retention structure to a/the corresponding infusion member prior to the filling the shell void volume with the shell fill material.

B21. The method of any of paragraphs B12-B20, wherein the engaging each infusion member with the at least one infusion member retention structure includes coupling at least one infusion member retention structure to a/the corresponding infusion member subsequent to the filling the shell void volume with the shell fill material.

B22. The method of any of paragraphs B1-B21, wherein the at least one infusion member includes at least one infusion sleeve, and wherein the method further includes, prior to the filling the shell void volume with the shell fill material, filling the at least one infusion sleeve with an infusion fill material.

B23. The method of paragraph B22, when dependent from any of paragraphs B12-B21, wherein the engaging each infusion member with the at least one infusion member retention structure includes coupling at least one infusion member retention structure to a/the corresponding infusion sleeve prior to filling the corresponding infusion sleeve with the infusion fill material.

B24. The method of any of paragraphs B22-B23, when dependent from any of paragraphs B12-B21, wherein the engaging each infusion member with the at least one infusion member retention structure includes coupling at least one infusion member retention structure to a/the corresponding infusion sleeve subsequent to filling the corresponding infusion sleeve with the infusion fill material.

B25. The method of any of paragraphs B22-B24, wherein the filling the at least one infusion sleeve with the infusion fill material includes flowing the infusion fill material into an end region of the infusion sleeve.

B26. The method of any of paragraphs B22-B25, wherein the filling the at least one infusion sleeve with the infusion fill material includes flowing the infusion fill material into the at least one infusion sleeve via a/the at least one infusion member port.

B27. The method of any of paragraphs B22-B26, wherein each infusion sleeve is a hollow infusion sleeve, and wherein the filling the at least one infusion sleeve with the infusion fill material is performed subsequent to the positioning the at least one infusion member within the shell internal volume.

B28. The method of any of paragraphs B22-B26, wherein each infusion sleeve is a pre-filled infusion sleeve, and wherein the filling the at least one infusion sleeve with the infusion fill material is performed prior to the positioning the at least one infusion member within the shell internal volume.

B29. The method of any of paragraphs B22-B28, wherein the method further includes, subsequent to the filling the at least one infusion sleeve with the infusion fill material, evacuating the at least one infusion sleeve of air.

B30. The method of paragraph B29, wherein the evacuating includes evacuating prior to the filling the shell void volume with the shell fill material.

B31. The method of any of paragraphs B29-B30, wherein the evacuating includes applying a vacuum to an infusion sleeve internal volume of the at least one infusion sleeve.

B32. The method of paragraph B31, wherein the applying the vacuum includes connecting the at least one infusion sleeve to a vacuum source via a/the at least one infusion member port.

B33. The method of paragraph B32, wherein the connecting the at least one infusion sleeve to the vacuum source includes connecting via an infusion member port of the at least one infusion member port that is different than an infusion member port through which the infusion fill material is inserted into the at least one infusion sleeve.

B34. The method of any of paragraphs B22-B33, wherein the method further includes, subsequent to the filling the at least one infusion sleeve with the infusion fill material, sealing the at least one infusion sleeve.

B35. The method of paragraph B34, wherein the sealing the at least one infusion sleeve includes positioning the at least one infusion sleeve such that the at least one infusion sleeve is fully received within the shell internal volume.

B36. The method of any of paragraphs B34-B35, wherein the sealing the at least one infusion sleeve includes positioning the at least one infusion sleeve such that the at least one infusion sleeve is coupled to at least one shell plug.

B37. The method of any of paragraphs B1-B36, wherein the filling the shell void volume with the shell fill material includes surrounding the at least one infusion member with the shell fill material.

B38. The method of any of paragraphs B1-B37, wherein the filling the shell void volume with the shell fill material includes overfilling the shell void volume such that the shell fill material fills the shell void volume and exits the shell internal volume via at least one of a/the at least one infusion member port and a/the at least one shell fill material port.

B39. The method of any of paragraphs B1-B38, wherein the method further includes, subsequent to the filling the shell void volume with the shell fill material, sealing the elongate shell such that the shell internal volume is watertight.

B40. The method of paragraph B39, when dependent from paragraph B4, wherein the sealing the elongate shell includes closing each infusion member port with a corresponding shell plug configured to form a watertight seal with the infusion member port.

B41. The method of paragraph B40, wherein the shell plug at least one of includes and is coupled to an accessory mount.

B42. The method of any of paragraphs B39-B41, wherein the method further includes, subsequent to the sealing the elongate shell, positioning at least one deck pad component on a top surface of the elongate shell to cover at least one of a/the at least one infusion member port and a/the at least one shell fill material port.

B43. The method of paragraph B41, wherein the accessory mount includes at least one of a handle, an anchor, and a tie-down point.

B44. The method of any of paragraphs B1-B43, wherein the method further includes, subsequent to the filling the shell void volume with the shell fill material, curing the shell fill material to lock the at least one infusion member in place relative to the elongate shell.

B45. The method of paragraph B44, wherein the curing the shell fill material includes at least one of an application of heat, an application of ultraviolet radiation, and a passage of time.

B46. A watersport board produced by the method of any of paragraphs B1-B45.

C1. The use of the methods of any of paragraphs B1-B45 to produce a watersport board.

C2. The use of the methods of any of paragraphs B1-B45 to produce the watersport board of any of paragraphs A1-A50.

INDUSTRIAL APPLICABILITY

The watersport boards and methods disclosed herein are applicable to the water sports industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A watersport board configured to operate upon a body of water, the watersport board comprising:

an elongate shell that defines a shell internal volume of the watersport board;

at least one infusion member positioned within the shell internal volume and defining an infusion member volume, such that the shell internal volume is separated by the at least one infusion member into the infusion member volume and a shell void volume; and a shell fill material positioned within the shell void volume;

wherein the at least one infusion member comprises a solid structure, a hollow structure, or an infusion sleeve, wherein the at least one infusion member has an average density that is less than a density of the shell fill material, wherein the elongate shell includes a nose, a tail, a left rail, a right rail, and a deck, wherein each of the left rail and the right rail extends between the nose and the tail, wherein the deck extends between the nose and the tail and between the left rail and the right rail, wherein the deck is configured to support a user standing upon the deck when the watersport board operates upon the body of water, wherein the at least one infusion member is spaced apart from each of the left rail and the right rail within the shell internal volume, and wherein the elongate shell defines at least one infusion member port configured to permit at least the structural component of the at least one infusion member to be inserted into the shell internal volume via the infusion member port during manufacture of the watersport board.

2. The watersport board of claim 1, wherein the at least one infusion member includes an infusion sleeve that defines an infusion sleeve internal volume, and wherein the at least one infusion member further includes an infusion fill material positioned within the infusion sleeve internal volume.

3. The watersport board of claim 2, wherein the infusion fill material includes at least one of a polymer, a foam, expanded polystyrene (EPS), a pressurized gas, and pressurized air.

4. The watersport board of claim 1, wherein the shell fill material occupies at least 95% of the shell void volume.

5. The watersport board of claim 1, wherein the infusion member volume occupies at least 30% of the shell internal volume.

6. The watersport board of claim 1, wherein the elongate shell has a shell longitudinal axis such that the elongate shell is symmetric with respect to the shell longitudinal axis, and wherein the at least one infusion member is positioned symmetrically with respect to the shell longitudinal axis.

7. The watersport board of claim 1, wherein the elongate shell includes a shell inner surface that defines the shell internal volume, and wherein the at least one infusion member is spaced apart from the shell inner surface.

8. The watersport board of claim 1, wherein the watersport board further includes at least one infusion member retention structure operatively coupled to at least one infusion member and configured to retain the at least one infusion member to which it is coupled in a fixed orientation with respect to the shell internal volume.

9. The watersport board of claim 8, wherein the at least one infusion member retention structure at least one of is coupled to and forms a portion of a shell plug that extends at least partially through the elongate shell.

10. The watersport board of claim 1, wherein the at least one infusion member is formed of an infusion member material that includes one or more of a plastic, a polymer, a foam, expanded polystyrene (EPS), a film, an air-impermeable material, and carbon fiber.

11. The watersport board of claim 1, wherein the at least one infusion member includes an exterior surface, and further wherein the exterior surface of the at least one infusion member contacts the shell fill material.

12. A method of forming a watersport board, the method comprising:

forming an elongate shell that defines a shell internal volume of the watersport board;

subsequent to the forming the elongate shell, positioning at least one infusion member within the shell internal volume, wherein the at least one infusion member collectively defines an infusion member volume, such that the shell internal volume is separated by the at least one infusion member into the infusion member volume and a shell void volume; wherein the at least one infusion member comprises a solid structure, a hollow structure, or an infusion sleeve; and filling the shell void volume with a shell fill material.

13. The method of claim 12, wherein the forming the elongate shell includes forming at least one infusion member port defined by the elongate shell and configured to permit access to the shell internal volume from external the elongate shell, and wherein the positioning the at least one infusion member within the shell internal volume includes inserting each infusion member into the shell internal volume via the at least one infusion member port.

14. The method of claim 13, wherein the positioning the at least one infusion member within the shell internal volume includes retaining each infusion member in a substantially fixed orientation with respect to the elongate shell.

15. The method of claim 14, wherein the at least one infusion member port includes a plurality of infusion member ports, and wherein the positioning the at least one infusion member within the shell internal volume includes inserting each infusion member into the shell internal volume such that each infusion member extends between a pair of opposed infusion member ports of the plurality of infusion member ports and through the shell internal volume and tensioning each infusion member between the pair of opposed infusion member ports to retain the at least one infusion member within the shell internal volume in the substantially fixed orientation with respect to the elongate shell.

16. The method of claim 14, wherein the retaining each infusion member includes engaging each infusion member with at least one infusion member retention structure.

17. The method of claim 16, wherein the watersport board further includes at least one shell plug that extends at least partially through the elongate shell, and wherein the at least one infusion member retention structure includes a loop that extends into the shell internal volume from the at least one shell plug and that supports the at least one infusion member relative to the shell internal volume.

18. The method of claim 16, wherein the at least one infusion member retention structure is defined by the elongate shell.

19. The method of claim 16, wherein the at least one infusion member retention structure engages at least two infusion members.

20. The method of claim 13, wherein the method further includes, subsequent to the filling the shell void volume with the shell fill material, positioning at least one deck pad component on a top surface of the watersport board to cover the at least one infusion member port.

21. The method of claim 12, wherein the at least one infusion member includes at least one infusion sleeve, and wherein the method further includes, prior to the filling the shell void volume with the shell fill material, filling the at least one infusion sleeve with an infusion fill material.

22. The method of claim 21, wherein the filling the at least one infusion sleeve with the infusion fill material is performed subsequent to the positioning the at least one infusion member within the shell internal volume.

23. The method of claim 21, wherein the filling the at least one infusion sleeve with the infusion fill material is performed prior to the positioning the at least one infusion member within the shell internal volume.

24. The method of claim 21, wherein the method further includes, subsequent to the filling the at least one infusion sleeve with the infusion fill material and prior to the filling the shell void volume with the shell fill material, evacuating the at least one infusion sleeve of air.

25. The method of claim 12, wherein the filling the shell void volume with the shell fill material includes surrounding the at least one infusion member with the shell fill material.

26. The method of claim 12, wherein the forming the elongate shell further includes forming at least one shell fill material port defined by the elongate shell and configured to permit access to the shell internal volume from external the elongate shell, and wherein the filling the shell void volume with the shell fill material includes flowing the shell fill material into the shell void volume via the at least one shell fill material port.

27. The method of claim 12, wherein the method further includes, subsequent to the filling the shell void volume with the shell fill material, sealing the elongate shell such that the shell internal volume is watertight.

* * * * *